US006588114B1

(12) United States Patent
Daigle

(10) Patent No.: US 6,588,114 B1
(45) Date of Patent: Jul. 8, 2003

(54) MEASURING PUMP DEVICE

(75) Inventor: Michael Phillip Daigle, Cockeysville, MD (US)

(73) Assignee: Michael Daigle, Cockeysville, MD (US)

( * ) Notice: Subject to any disclaimer, the term of this patent is extended or adjusted under 35 U.S.C. 154(b) by 158 days.

(21) Appl. No.: 09/612,365

(22) Filed: Jul. 7, 2000

(51) Int. Cl.[7] ..... B61K 9/08; E01B 29/04

(52) U.S. Cl. ..... 33/1 Q; 33/523.1; 33/287

(58) Field of Search ..... 33/523.1, 1 Q, 33/549, 787, 427, 464, 790, 806, 521, 832, 287

(56) References Cited

U.S. PATENT DOCUMENTS

| | | | | | |
|---|---|---|---|---|---|
| 442,020 | A | * | 12/1890 | Darling | 33/832 |
| 498,726 | A | * | 5/1893 | Preston | 33/342 |
| 855,338 | A | * | 5/1907 | Raymond | 33/427 |
| 1,379,253 | A | * | 5/1921 | Dorney | 33/806 |
| 1,438,404 | A | * | 12/1922 | Schweikert et al. | 33/287 |
| 1,509,141 | A | * | 9/1924 | Grovedahl | 33/523.1 |
| 1,615,714 | A | * | 1/1927 | Magaton | 33/523.1 |
| 1,801,112 | A | * | 4/1931 | Schultz et al. | 33/287 |
| 1,922,895 | A | * | 8/1933 | Lemaire | 33/521 |
| 1,979,886 | A | * | 11/1934 | Keith | 33/287 |
| 2,029,665 | A | * | 2/1936 | Markowicz | 33/832 |
| 2,325,558 | A | * | 7/1943 | Uslan | 33/832 |
| 2,468,995 | A | * | 5/1949 | Morrison | 33/832 |
| 2,519,942 | A | * | 8/1950 | Tedrick | 33/832 |
| 2,763,931 | A | * | 9/1956 | McMillan | 33/287 |
| 2,784,496 | A | * | 3/1957 | Rouses | 33/521 |
| 2,915,928 | A | * | 12/1959 | Baxter | 33/832 |
| 2,926,426 | A | * | 3/1960 | Lury | 33/832 |
| 3,021,601 | A | * | 2/1962 | Hayes | 33/287 |
| 3,038,332 | A | * | 6/1962 | Grossmann | 33/523.1 |
| 3,148,630 | A | * | 9/1964 | Moore et al. | 33/523.1 |
| 3,392,451 | A | * | 7/1968 | Lombardo | 33/523.1 |
| 3,882,607 | A | * | 5/1975 | Plasser et al. | 33/1 Q |
| 4,794,697 | A | * | 1/1989 | Carey-Yard | 33/1 Q |
| 5,325,798 | A | * | 7/1994 | Nowell et al. | 33/809 |
| 5,397,083 | A | * | 3/1995 | Thomas | 33/523.1 |
| 5,491,907 | A | * | 2/1996 | Vidmar | 33/832 |
| 5,617,639 | A | * | 4/1997 | Perry | 33/1 Q |
| 5,660,470 | A | * | 8/1997 | Mench | 33/1 Q |
| 5,671,540 | A | * | 9/1997 | Davis | 33/287 |
| 6,247,243 | B1 | * | 6/2000 | Check | 33/783 |
| 6,105,269 | A | * | 8/2000 | Kondrat | 33/512 |
| 6,119,353 | A | * | 9/2000 | Gronskov | 33/1 Q |
| 6,226,881 | B1 | * | 5/2001 | Landauer | 33/515 |

FOREIGN PATENT DOCUMENTS

| | | | | | |
|---|---|---|---|---|---|
| JP | 55154401 | A | * | 12/1980 | 33/832 |

* cited by examiner

*Primary Examiner*—Diego Gutierrez
*Assistant Examiner*—Mirellys Jagan

(57) ABSTRACT

A light weight compact device used in a rail road track maintenance organization carried by a track inspector to measure the vertical difference in track or rail of the track under normal operating conditions of trains which does not obstruct the travel of trains over the tracks by using this device which is placed under the rail, locked in place to keep any part of the device from being struck by the wheel of the train or train equipment while still capable of measuring the vertical movement of the rail or track.

1 Claim, 2 Drawing Sheets

MEASURING PUMP DEVICE

A tool used to measure the distance that the base of the rail travels in a downward motion when a train travels over substandard track conditions.

CROSS REFERENCE TO RELATED APPLICATIONS

Not Applicable

STATEMENT REGARDING FEDERALLY SPONSORED RESEARCH OR DEVELOPMENT

Not applicable

REFERENCE TO A MICROFICHE APPENDIX

Not Applicable

BACKGROUND OF THE INVENTION

This tool specifically applies to railroad safety and maintenance of track conditions such as fouled ballast or mud spots as they are referred to by track inspectors. This tool will enable an inspector to immediately determine the appropriate speed restriction to be placed on a section of track for the safe passage of freight and passenger trains according to measurements taken and requirements set by the Federal Railroad Administration (FRA).

Currently, inspectors measure any marks on the sides of the ties to determine how much travel the tie pushes down under the load of the train as it passes over a mud spot. This is done with a folding six foot ruler. Most of the time there is a lot of water and ballast around the ties which restricts the inspector from making an accurate measurement of the condition. When the condition is so severe that the ballast has turned to mud, then no measurement can be taken which could cause a serious track condition if no speed restriction is placed on the track.

BRIEF SUMMARY OF THE INVENTION

This tool is attached to the base of the rail at the mud spot or foul ballast section. Then the measuring ruler is lowered to the ballast below and as the train runs over the track and pushes down on the rail, the arm is pushed up and takes the measurement of the pump under load. This measurement allows the inspector to make an accurate measurement of the defect and place the appropriate speed restriction on the track if needed for the safety of the passenger and cargo on the trains. Then maintenance can be scheduled on the track for the necessary repairs required.

BRIEF DESCRIPTION OF THE SEVERAL VIEWS OF THE DRAWING

Figure 1:
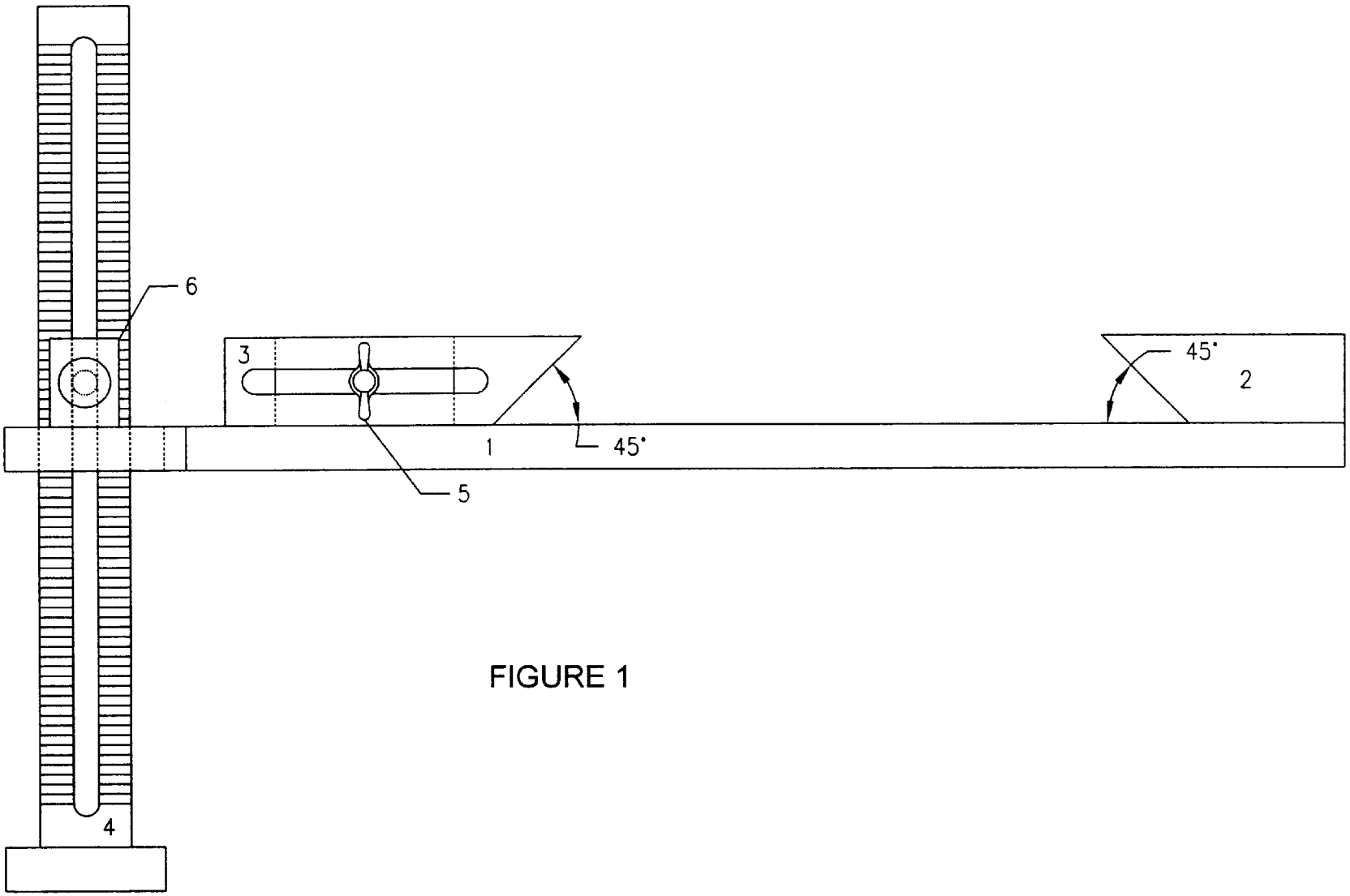

DRAWING A:

Side View

1). The Base: Attaches under the base of the rail

2). Stationary Wedge: Attaches to the inside of the rail

3). Movable Wedge: Locks tool to the base of the rail

4). Movable Sliding Ruler: Adjusts up and down to take measurements

5). One locking wing nut: Tightens the movable wedge

6). One Stationary Block: Holds ruler in place

DRAWING B:

Top View

1). The Base: Attaches under the base of the rail

2). Two Stationary Wedges: On the right edge of the base

3). Two Movable Wedges: On the left side just off center

4). Movable Sliding Ruler: Far left and center of base

5). Three locking wing nuts and bolts: 2 are Stainless steel ¼ inch by 2 inches 3$^{rd}$ is Stainless steel ¼ inch by 2¼ inch

6). Two Stationary Blocks: Holds ruler in place

7). Two Stationary Blocks: Holds movable wedges in place

DETAILED DESCRIPTION OF THE INVENTION

This tool is one that can be applied to any railroad in the United States or to any country that has railroads. As the growing needs for faster inter city travel and higher speeds also comes the factor of safer railroads and equipment. With this in mind there is also the fact of the track standards set by the Federal Railroad Administration (F.R.A.) and the safety standards that they also impose on all railroads. With higher speeds there is a greater need for safety for the passenger. As of now we are looking at track speed that will exceed 150 miles an hour at the end of this year. Our tracks need to be kept at the maintenance and construction limits and also the safety limits, some that have only up to a half inch from design. We have tools now that will measure cross level of any track and tools that will measure the profile of the rail and also alignment. However, we have not a tool that will measure the pump under a load. When I talk about a load, I am describing the down ward pressure of the train as it goes over the track and its effects to the ties and the ballast under and around the tie. Cause and effect is the constant pounding of the train on the ballast that with enough pounding causes the ballast to deteriorate. Ballast is a rock that all railroads use and is a Gen. Starr 2A railroad size #4. With any rock, when it is crushed enough will turn to sand, now add the element of moisture or water from a rain fall and you have mud. We call this saturated ballast or mud spots. This can cause a profile situation which is a dip in both rails or a difference in cross level if it is on one rail. As I said earlier, we can measure the amount of the latter but we also need to determine the amount of the pump. Depending on the class of track that we are dealing with an Inspector would have to place a speed restriction on this track for the safety of the passenger. The cross level may not be so extensive for a speed restriction, but it could cause a lateral movement of the train. This would cause a severe G. force and throw a passenger around inside of the train. When it comes to G forces, we call this Passenger Ride Quality and we have speed restrictions for this also.

As of now we don't have a tool to measure pump. Presently, the only way we have to measure the pump is to visually look at any marks or mud that has built up on the side of the tie and measure it and it is not an accurate measurement by any means which could cause a safety situation for the passengers.

Here are the specifications on my invention that is called Measuring Pump Device. It is 15" inches long and 6" inches wide (FIG. 1 and 2 number1) and 2" inches at its shortest measurement. It has a total height of 1 and ½ inches, the base is ½" inches thick. It has two moveable parts that measure 4" inches long and ½" inches wide by 1 inch tall and have a 45 degree angle on them.(FIG. 1 and 2 number 3) There are also two other pieces that are 2 and ¾" inches long by ½" wide by 1" inch tall and have a 45 degree angle on them also and are stationary on one end.(FIG. 1 amd 2 number 2) There are four blocks that are stationary. Two of them are on the 4" inch moveable wedges and measure 2" inches long by ½" inch wide and 1" inch tall(FIG. 2 number 7) and the other two blocks are stationary and hold the measuring ruler and measure ¾" inch tall by ½" wide by ¾" long(FIG. 1 and 2 number 6).

Figure 2:
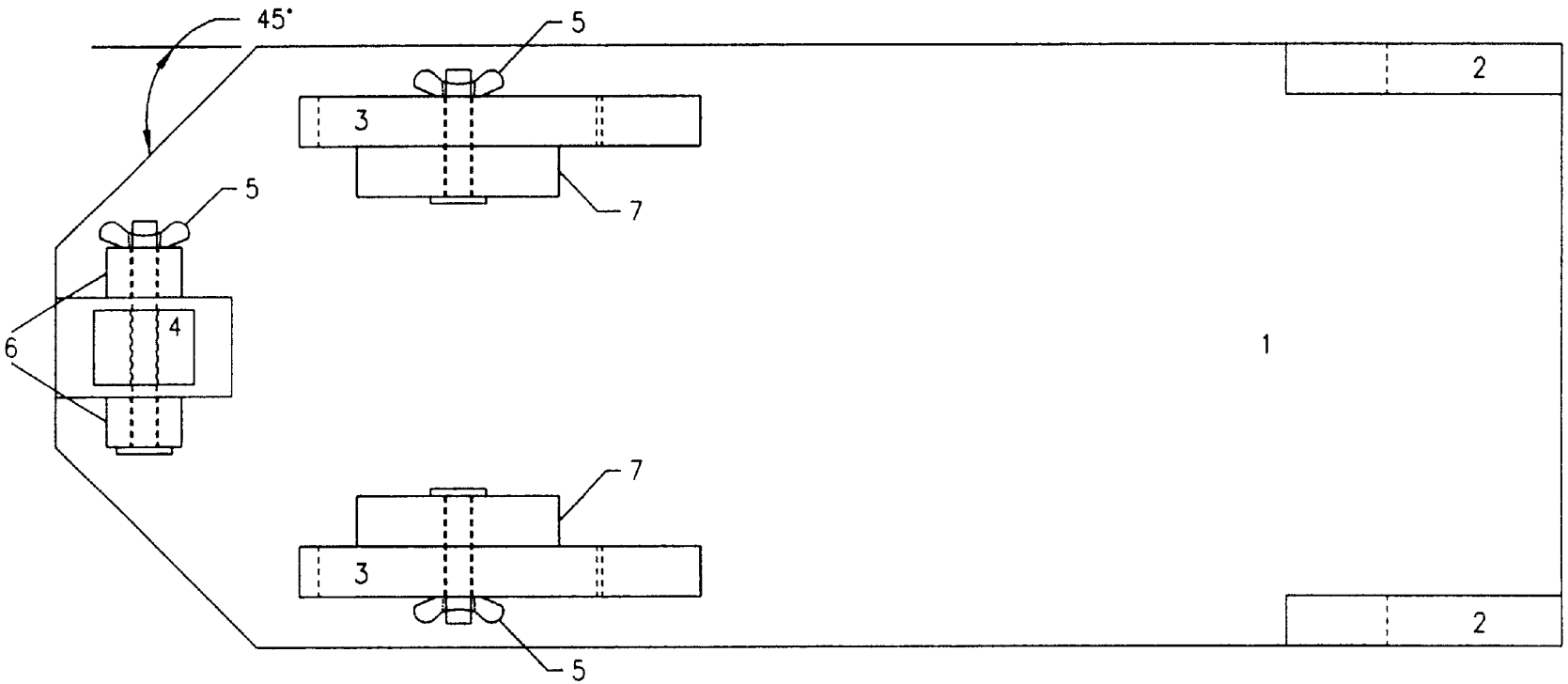

There is a measuring ruler that also moves that is 1" inch by ¾" inches and lowers down, and its length is 10" inches long(FIG. 1 and 2 number 4). There are three wing nuts and three bolts. Two of the bolts are ¼" inches by 2" inches long and the other bolt on the ruler part is ¼" inch by 2¼" inches long (FIG. 2 number 5). With exceptions to the bolts and wing nuts that will be of stainless steel the entire device will be of 60–61 grade aluminum. I have also sent along a set of the diagram of this tool.

Height—1½" Inches Tall

Length—15" Inches Long

Width—6" Inches Wide

Moveable parts—3 Pieces—2 Moveable wedges and 1 Moveable Ruler

Bolts—3 Stainless Steel Carriage Bolts—¼" inch by 2" inch×2 and 1¼" by 2¼" inches Material—60–61 Grade Aluminum The measuring pump device is assembled by attaching two moveable 4 inch wedges to the middle stationary blocks by using two stainless steel carriage bolts, wing nuts and washers. The measuring ruler is attached by using one stainless steel carriage bolt, wing nut and washer to the front stationary blocks. All stationary blocks are welded to the base. The two blocks for the moveable wedge and the two blocks for the moveable ruler have a ¼ inch centered hole. The 4 inch moveable blocks have a slot that is centered in the wedge and measures 2 inches long by 9/32 wide. The sliding ruler has a slot that measures 8¾ inches long by 9/32 wide and 4 washer, 2 on each side of ruler. There are 7⅝×¼ inch washers. The ruler has inch marking on each side from 1 to 10 inches in increments of ⅛ inch. The sliding ruler has a foot that measures 1¾ by 1⅜ inch square. With exceptions to the bolts, wing nuts and washers all other parts are made of 60–61 grade aluminum.

The measuring pump device is attached to the base of any rail by first raising the sliding ruler 90 degrees and then sliding the base plate under the rail until the stationary wedges can be raised up to hold the device in place by sliding the wedges towards the person installing it. Then the moveable wedges are raised up to the rail and slid in place over the top part of the base of the rail and tightened securely to the base of the rail. After the installation is complete, the sliding ruler is lowered to where the foot touches the ground (ballast or rocks) and tightened sufficiently to ensure proper tension for the up and down movement of the ruler to take the exact measurement before a train traveling over the track where the device is installed can make an exact measurement. Now a measurement can be taken at the top of the sliding rulers stationary block and recorded on a piece of paper. When the train passes over the device the ruler will be pushed up and a second measurement can be taken and recorded. This will now give the differences of the two measurements and give an exact amount to the inspector.

What is claimed is:

1. An apparatus for measuring the pump of a rail with respect to the ground as a train travels over the rail, the apparatus comprising:

a flat base plate having a planar upper surface and an opening, two stationary wedges permanently attached to the upper surface of the base plate, the stationary wedges each having an angled side forming a forty-five degree angle with the planar upper surface of the base plate, two stationary center blocks each having a hole therethrough for inserting an adjustable screw, the center blocks being permanently attached to the upper surface of the base plate and located opposite of the stationary wedges, two moveable wedges each having a slot for slidably attaching each moveable wedge to a stationary center block by means of the adjustable screw and a wing nut so as to allow the moveable wedges to slidably move over the upper surface, the moveable wedges located opposite to the two stationary metal wedges and each having an angled side forming a forty-five degree angle with the planar upper surface of the base plate, wherein the angled sides of the stationary wedges and the angled sides of the moveable wedges face each other thereby forming a clamping mechanism for clamping a bottom flange of a rail therebetween and locking the base plate under the rail, two stationary front blocks each having a hole therethrough for inserting an adjustable screw, the front blocks being permanently attached to the upper surface of the base plate opposite of the center blocks, each block placed on opposite sides of the opening of the base plate, the center blocks being located between the front blocks and the stationary wedges, a ruler having measuring indicia and a slot formed through its center for slidably attaching the ruler to the front blocks by means of the adjustable screw and a wing nut, the ruler extending perpendicularly to the upper surface through the opening in the base plate so as to allow the ruler to move in a vertical direction, thereby providing a measurement of the vertical displacement of the rail with respect to the ground as a train travels over the rail.

* * * * *